US010488796B2

(12) United States Patent
Kawata et al.

(10) Patent No.: US 10,488,796 B2
(45) Date of Patent: Nov. 26, 2019

(54) FIXING DEVICE CONTROLLER, IMAGE FORMING APPARATUS, FIXING DEVICE CONTROL METHOD, AND NON-TRANSITORY COMPUTER-READABLE RECORDING MEDIUM STORING FIXING DEVICE CONTROL PROGRAM

(71) Applicants: Teppei Kawata, Kanagawa (JP); Shinichi Namekata, Kanagawa (JP); Akiyasu Amita, Kanagawa (JP); Masateru Ujiie, Kanagawa (JP); Yohhei Watanabe, Kanagawa (JP); Fumihiro Hirose, Kanagawa (JP); Takashi Sakamaki, Kanagawa (JP)

(72) Inventors: Teppei Kawata, Kanagawa (JP); Shinichi Namekata, Kanagawa (JP); Akiyasu Amita, Kanagawa (JP); Masateru Ujiie, Kanagawa (JP); Yohhei Watanabe, Kanagawa (JP); Fumihiro Hirose, Kanagawa (JP); Takashi Sakamaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/021,060

(22) Filed: Jun. 28, 2018

(65) Prior Publication Data

US 2019/0011864 A1 Jan. 10, 2019

(30) Foreign Application Priority Data

Jul. 5, 2017 (JP) ..... 2017-131945
Jun. 19, 2018 (JP) ..... 2018-116332

(51) Int. Cl.
*G03G 15/20* (2006.01)
*G03G 15/16* (2006.01)

(52) U.S. Cl.
CPC ..... *G03G 15/2053* (2013.01); *G03G 15/1615* (2013.01); *G03G 15/2017* (2013.01); *G03G 15/2039* (2013.01)

(58) Field of Classification Search
CPC ... G03G 2215/2035; G03G 2215/2032; G03G 15/2039; G03G 15/2053; G03G 15/2028
See application file for complete search history.

(56) References Cited

U.S. PATENT DOCUMENTS

2010/0322657 A1* 12/2010 Kumada ..... G03G 15/5004 399/69
2014/0212188 A1 7/2014 Watanabe
(Continued)

FOREIGN PATENT DOCUMENTS

| | | |
|---|---|---|
| JP | 2016-012454 | 1/2016 |
| JP | 2016-028262 | 2/2016 |
| JP | 2016-040595 | 3/2016 |

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A fixing device controller includes a plurality of voltage detectors to detect voltages of a plurality of power sources for supplying power to a plurality of heaters to heat a fixing member of a fixing device that fixes a toner image on a recording medium and a heater controller to execute duty control to turn on the plurality of heaters. The heater controller corrects a duty of at least one of the plurality of heaters based on the voltages detected by the plurality of voltage detectors and rated output values of the plurality of heaters.

11 Claims, 11 Drawing Sheets

(56) References Cited

U.S. PATENT DOCUMENTS

| | | | | |
|---|---|---|---|---|
| 2014/0294456 | A1 | 10/2014 | Ueno et al. | |
| 2015/0078770 | A1 | 3/2015 | Yamano et al. | |
| 2015/0093134 | A1* | 4/2015 | Itoh | G03G 15/2039 399/67 |
| 2016/0004199 | A1 | 1/2016 | Suzuki et al. | |
| 2016/0170350 | A1 | 6/2016 | Hirose et al. | |
| 2016/0202646 | A1 | 7/2016 | Suzuki et al. | |
| 2016/0306304 | A1 | 10/2016 | Hemmi et al. | |
| 2016/0363898 | A1 | 12/2016 | Ujiie | |
| 2017/0090368 | A1 | 3/2017 | Ujiie et al. | |
| 2017/0097600 | A1 | 4/2017 | Kawata et al. | |
| 2017/0269522 | A1 | 9/2017 | Kubota et al. | |
| 2017/0269525 | A1 | 9/2017 | Okamoto et al. | |
| 2017/0269526 | A1 | 9/2017 | Yuasa et al. | |
| 2017/0357197 | A1 | 12/2017 | Okamoto et al. | |
| 2017/0357198 | A1 | 12/2017 | Namekata et al. | |
| 2018/0081309 | A1 | 3/2018 | Hirose et al. | |
| 2018/0088502 | A1 | 3/2018 | Sugiyama et al. | |

* cited by examiner

| CONDITION 1 | APPLIED VOLTAGE | OUTPUT POWER | CONTROL PATTERN |
|---|---|---|---|
| FIRST MAIN HEATER | 264 | 1587.981 | DUTY |
| SECOND MAIN HEATER | 264 | 1587.981 | ON/OFF (1) |
| SUB-HEATER | 187.2 | 935.2466 | ON/OFF (2) |

| CONDITION 3 | APPLIED VOLTAGE | OUTPUT POWER | CONTROL PATTERN |
|---|---|---|---|
| FIRST MAIN HEATER | 264 | 1587.981 | DUTY FROM 0 TO 100 |
| SECOND MAIN HEATER | 264 | 1587.981 | DUTY FROM 100 TO 200 |
| SUB-HEATER | 187.2 | 935.2466 | DUTY FROM 200 TO 300 |

| CONDITION 4 | APPLIED VOLTAGE | OUTPUT POWER | CONTROL PATTERN |
|---|---|---|---|
| FIRST MAIN HEATER | 264 | 1587.981 | DUTY FROM 200 TO 300 |
| SECOND MAIN HEATER | 264 | 1587.981 | DUTY FROM 100 TO 200 |
| SUB-HEATER | 187.2 | 935.2466 | DUTY FROM 0 TO 100 |

FIXING DEVICE CONTROLLER, IMAGE FORMING APPARATUS, FIXING DEVICE CONTROL METHOD, AND NON-TRANSITORY COMPUTER-READABLE RECORDING MEDIUM STORING FIXING DEVICE CONTROL PROGRAM

CROSS-REFERENCE TO RELATED APPLICATIONS

This patent application is based on and claims priority pursuant to 35 U.S.C. § 119 to Japanese Patent Applications No. 2017-131945, filed on Jul. 5, 2017 and No. 2018-116332, filed on Jun. 19, 2018 in the Japanese Patent Office, the entire disclosure of which is hereby incorporated by reference herein.

BACKGROUND

Technical Field

The present disclosure relates to a fixing device controller, an image forming apparatus, a fixing device control method, and a non-transitory computer-readable recording medium storing the fixing device control program.

Description of the Related Art

Conventionally, in an electrophotographic image forming apparatus such as a copier, a facsimile machine, or a printer, a heat fixing device is widely used to fix an unfixed toner image transferred onto a recording medium such as a transfer paper. Techniques for solving issues with control of the heaters used in the fixing device, such as providing good fixing temperature tracking (stability) while at the same time reducing harmonics and flicker as required by the European Union (EU) in its electromagnetic compatibility (EMC) directive.

A technique called "allocation control" is one method of turning on a fixing heater that clears the flicker threshold of the EMC directive and supplies the required duty of the fixing device without fluctuation of the waveform. In allocation control, one of the heaters is under duty control, and the other heaters are under on/off control.

SUMMARY

This specification describes an improved fixing device controller. The fixing device controller includes a plurality of voltage detectors to detect voltages of a plurality of power sources for supplying power to a plurality of heaters to heat a fixing member of a fixing device that fixes a toner image on a recording medium and a heater controller to execute duty control to turn on the plurality of heaters. The heater controller corrects a duty of at least one of the plurality of heaters based on the voltages detected by the plurality of voltage detectors and rated output values of the plurality of heaters.

This specification further describes an improved fixing device control method for controlling a fixing device having a plurality of heaters to fix a toner image onto a recording medium using a fixing member in an image forming apparatus. The fixing device control method includes detecting voltages of a plurality of power sources for supplying power to a plurality of heaters to heat the fixing member and correcting, when the plurality of heaters are controlled by duty control, a duty of at least one of the plurality of heaters based on the detected voltages and the rated output values of the plurality of heaters.

This specification still further describes a non-transitory computer-readable recording medium with an executable program stored thereon, wherein the program, when executed, instructs an image forming apparatus to execute the fixing device control method.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
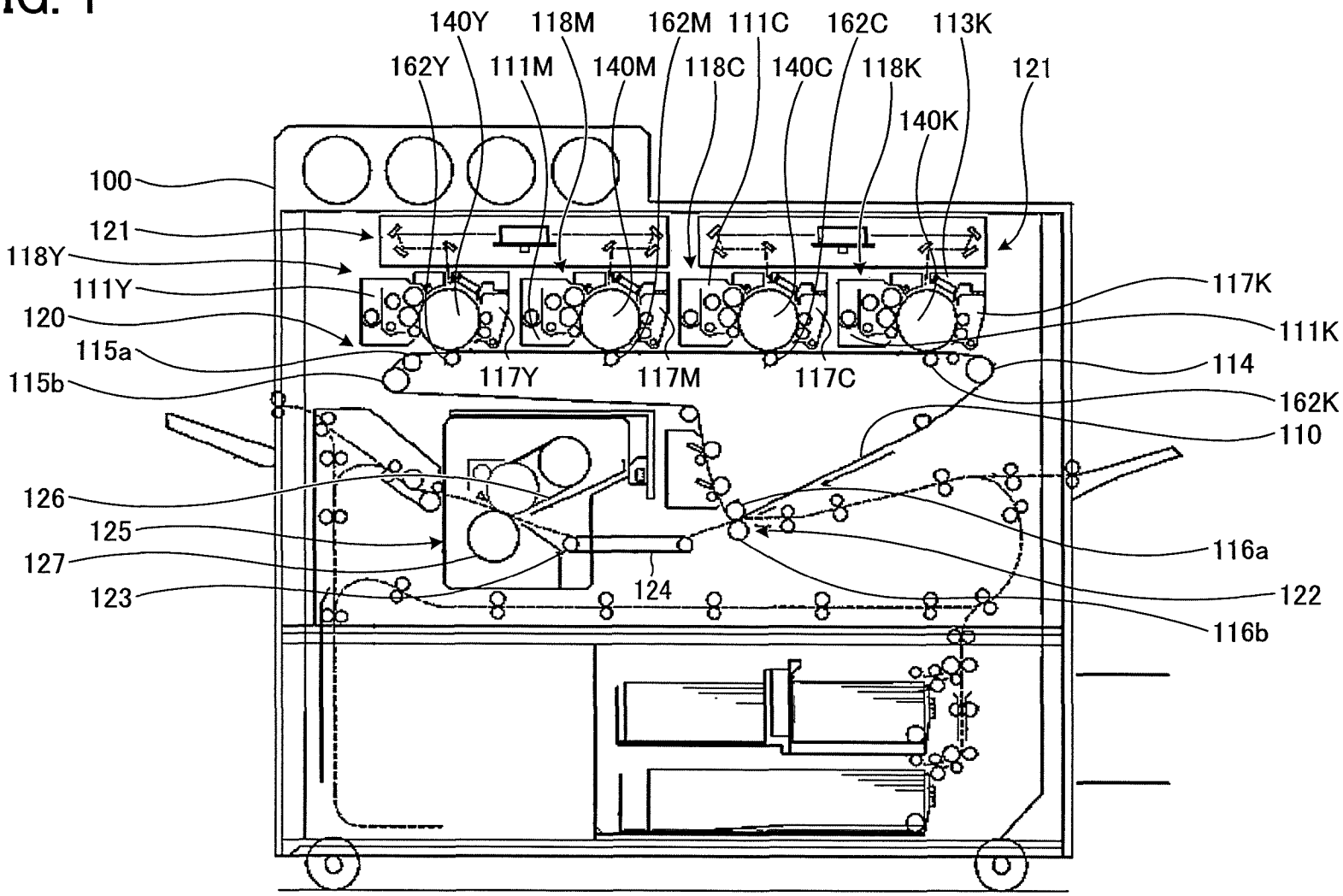
FIG. 1 is a schematic diagram illustrating an example of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

Hereinafter, embodiments of a fixing device controller, an image forming apparatus, a fixing device control method, and a non-transitory computer-readable storage medium storing the heater control program according to the present disclosure are described in detail with reference to the accompanying drawings.

Embodiments

FIG. 1 is a schematic diagram illustrating an example of an image forming apparatus 100 according to the present embodiment.

The image forming apparatus 100 in FIG. 1 has an image forming apparatus body including a tandem intermediate transfer system. A sheet feed table is disposed in a lower portion of the image forming apparatus 100. The image forming apparatus 100 has a tandem image forming section 120 employing a tandem intermediate transfer method. In the image forming section 120, image forming devices 118Y, 118M, 118C, and 118K are arranged side by side. Here, the additional characters Y, M, C, and K respectively represent the colors of yellow, magenta, cyan, and black. An endless belt serving as an intermediate transferor, which is called an intermediate transfer belt 110 hereinafter, is disposed in a substantially center portion of the image forming apparatus 100. The intermediate transfer belt 110 is entrained around a plurality of support rollers 114, 115*a*, 115*b*, and 116*a* and rotatable clockwise in FIG. 1.

An intermediate transfer belt cleaner 117 is disposed on the left side of the support roller 116*a* in FIG. 1. The intermediate transfer belt cleaner 117 removes residual toner failed to be transferred onto a sheet S and therefore remaining on the intermediate transfer belt 30 therefrom. Above an upper face of the intermediate transfer belt 110 stretched taut across the support rollers 114 and 115*a*, the four image forming devices 118Y, 118M, 118C, and 118K are aligned horizontally in a rotation direction of the intermediate transfer belt 110 to form yellow, magenta, cyan, and black toner images, respectively, thus constituting the tandem image forming section 120. The image forming devices 118Y, 118M, 118C, and 118K of the tandem image forming section 120 include photoconductor drums 140Y, 140M, 140C, and 140K serving as image bearers that bear yellow, magenta, cyan, and black toner images, respectively.

Above the image forming section 120, two exposure devices 121 are disposed as illustrated in FIG. 1. One of the exposure devices 121 corresponds to two image forming devices 118Y and 118M, and the other corresponds to the other two image forming devices 118C and 118K. Each of the exposure devices 121 may be an optical scanning exposure device composed of two light sources (e.g., semiconductor laser, semiconductor laser array, multibeam light source), a coupling optical system, a common optical deflector (e.g., polygon mirror), two-types of scanning imaging forming optical systems, and the like. The exposure devices 121 irradiate photoconductor drums 140Y, 140M, 140C, and 140K based on image information of yellow, magenta, cyan, and black, respectively, to form electrostatic latent images of each color.

Around each of the photoconductor drums 140Y, 140M, 140C, and 140K, a charger 113Y, 113M, 113C, and 113K for uniformly charging the photoconductor drum prior to the light irradiation, a developing device 111Y, 111M, 111C, and 111K for developing an electrostatic latent image formed by the exposure devices 121 with each of yellow, magenta, cyan, and black toner, and a photoconductor cleaner 117Y, 117M, 117C, and 117K for removing residual toner remaining on the photoconductor drum are provided. At a primary transfer position where a toner image is transferred from each of the photoconductor drums 140Y, 140M, 140C, and 140K onto the intermediate transfer belt 110, each of primary transfer rollers 162Y, 162M, 162C, and 162K is disposed facing the corresponding photoconductor drum 140Y, 140M, 140C, or 140K with the intermediate transfer belt 110 therebetween.

Among the plurality of support rollers 114, 115*a*, 115*b*, and 116*a* that support the intermediate transfer belt 110, the support roller 114 is a driving roller that drives and rotates the intermediate transfer belt 110. The support roller 30*a* is coupled to a driving motor through a driving force transmitter (e.g., a gear, a pulley, and a belt). In the case of forming a black monochrome image on the intermediate transfer belt 110, the support rollers 115*a* and 115*b* are displaced so that the intermediate transfer belt 110 is drawn away from the photoconductor drums 140Y, 140M, and 140C.

A secondary transfer device 122 is disposed opposite the tandem image forming section 120 via the intermediate transfer belt 110. The secondary transfer device 122 includes a secondary transfer roller 116*b* pressed against the support roller 116*a* serving as a secondary transfer opposed roller via the intermediate transfer belt 110. The secondary transfer roller 116*b* generates a transfer electric field to secondarily transfer the color toner image formed on the intermediate transfer belt 110 onto a sheet S as a transfer medium. A fixing device 125 is disposed downstream from the secondary transfer device 122 to fix a transferred and unfixed toner image onto the sheet S by heat and pressure.

The fixing device 125 includes a fixing belt 126 in the form of a seamless belt and a pressure roller 127 pressed against the fixing belt 126. The fixing belt 126 is entrained around two support rollers. A heater (e.g., a heater, a lamp, or an induction heater employing an electromagnetic induction heating method) is disposed inside at least one of the two support rollers. In the fixing device 125, a heater controller described later controls the operation of the heater.

A conveyance belt 124 supported by two rollers 123 conveys the sheet S bearing the color toner image transferred from the intermediate transfer belt 110 by the secondary transfer device 122 to the fixing device 125. Instead of the conveyance belt 124, a stationary guide, a conveyance roller, or the like may be used.

Below the secondary transfer device 122 and the fixing device 125, a sheet reverse device is disposed in parallel with the tandem image forming section 120 in FIG. 1. The sheet reverse device 90 reverses and conveys the sheet S for duplex printing to print another toner image on a back side of the sheet S. The sheet S bearing the fixed color toner image is ejected by an output roller pair onto an output tray.

Figure 2:
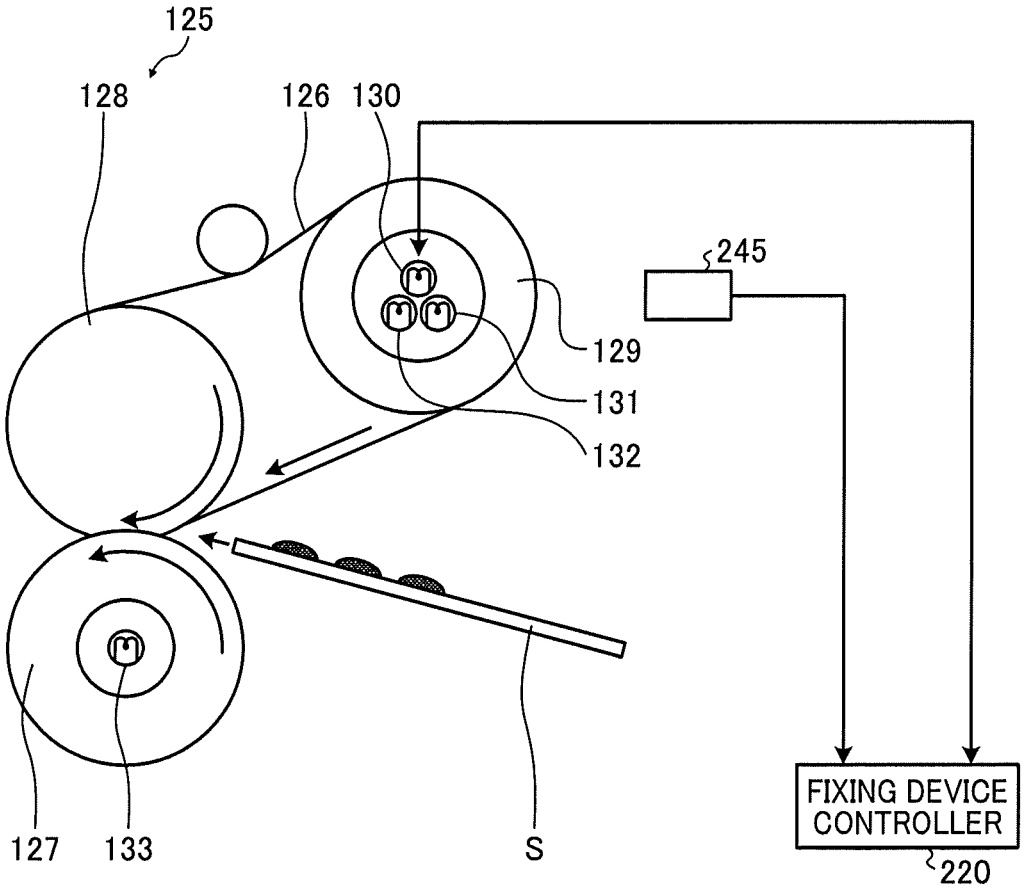
FIG. 2 is an explanatory diagram illustrating a configuration example of a fixing device according to the embodiment.

FIG. 2 is an explanatory diagram illustrating a configuration example of the fixing device 125 according to the present embodiment. The fixing device 125 of the present embodiment employs a belt fixing method and includes the fixing belt 126, the pressure roller 127, a fixing roller 128, a heating roller 129, and the like.

The fixing belt 126 is an endless belt in which silicone rubber and perfluoroalkoxy alkane (PFA) that is one of fluorocarbon-polymers are coated on a base material of polyimide resin (PI). The fixing belt 126 is made of a material having excellent releasability on its surface to avoid toner adhesion during fixing. The pressure roller 127 is made of a metallic cored bar and silicone rubber, has a heater 133 in the metallic cored bar, and pressed at a predetermined pressure toward the fixing roller 128. The fixing roller 128 is constructed of a metallic cored bar and silicone rubber. The heating roller 129 is a tube made of aluminum. A heat pipe is embedded in the aluminum portion of the heating roller 129, which makes the temperature in the axial direction of the heating roller 129 uniform.

Three halogen heaters, a first heater 130, a second heater 131, and a third heater 132, are inside a hollow portion of the heating roller 129. The first heater 130 is a halogen heater with an output of 1100 W and a rated voltage of 200V. A voltage is applied to the first heater 130 from a plurality of power cables described later. The second heater 131 is a heater having the same specification as that of the first heater 130, and a voltage is applied from a power cable described later. The third heater 132 is a heater having the same specification as that of the second heater 131, and a voltage is applied from the power cable described later. A temperature sensor 245, for example, using a thermopile, is disposed in the vicinity of the heating roller 129 to monitor the temperature of the fixing belt 126. The turn-on control of the first heater 130, the second heater 131, and the third heater 132 is described later.

Figure 3:
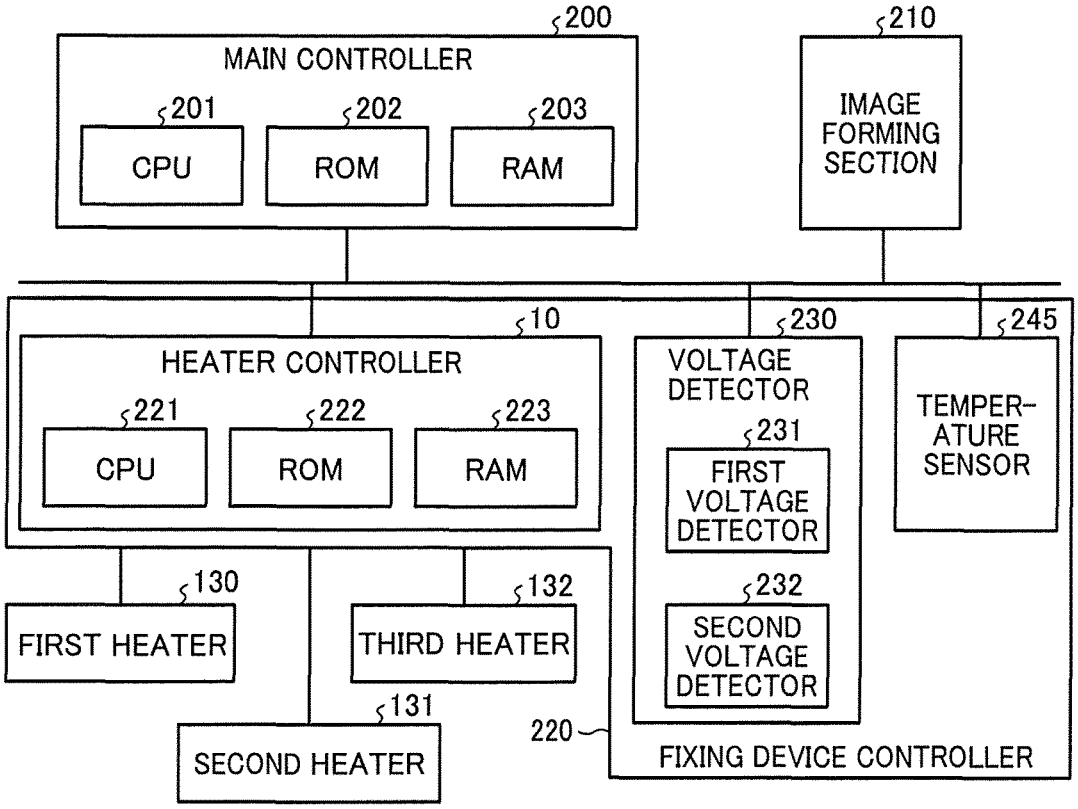
FIG. 3 is a block diagram illustrating a hardware configuration of the image forming apparatus according to the embodiment.

FIG. 3 is a block diagram illustrating a hardware configuration of the image forming apparatus 100 according to the present embodiment. As illustrated in FIG. 3, the image forming apparatus 100 includes a main controller 200, an image forming section 210, a fixing device controller 220, and the like. The main controller 200 is a microcomputer system that includes a central processing unit (CPU) 201, a read only memory (ROM) 202, and a random access memory (RAM) 203. The fixing device controller 220 includes a heater controller 10, a voltage detector 230, and a temperature sensor 245.

The main controller 200 totally controls each unit of the image forming apparatus 100. The fixing device controller 220 executes turn-on control of the first heater 130, the second heater 131 and the third heater 132 in the fixing device 125 according to a predetermined control signal sent from the main controller 200. The heater controller 10 includes a CPU 221, a ROM 222, and RAM 223. The voltage detector 230 includes a first voltage detector 231 and a second voltage detector 232. The voltage detector 230 detects the voltages applied from the power cables to the heaters, and feeds back the detected voltages to the heater controller 10.

Figure 4:
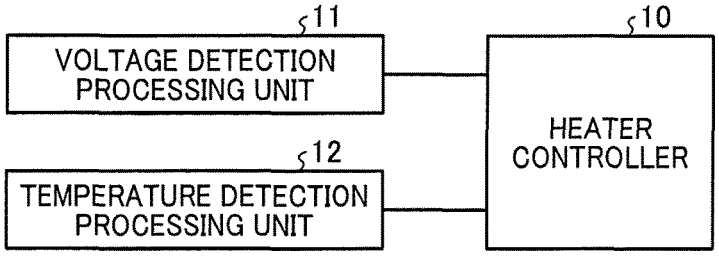
FIG. 4 is a block diagram illustrating a functional configuration of the image forming apparatus according to the embodiment.

FIG. 4 is a block diagram illustrating a functional configuration of the image forming apparatus 100 according to the present embodiment. As illustrated in FIG. 4, the image forming apparatus 100 has the heater controller 10, a voltage detection processing unit 11, a temperature detection processing unit 12, and the like.

The voltage detection processing unit 11 inputs voltage values applied to each of heaters to the heater controller 10. The first voltage detector 231 and the second voltage detector 232 detect the voltage values. The heater controller 10 executes predetermined processing. The voltage detection processing unit 11 detects voltage values of a plurality of power supplies that supply electric power to each of the plurality of heaters that heat the fixing belt 126. The temperature detection processing unit 12 inputs the temperature value in the vicinity of the fixing belt 126 in the fixing device 125, which the temperature sensor 245 detects, to the heater controller 10, and the heater controller 10 executes predetermined processing.

The heater controller 10 assigns the maximum turn-on duty obtained by adding the turn-on duties of the plurality of heaters to each of the plurality of heaters so that the maximum output value of each of the plurality of heaters becomes a constant value. The heater controller 10 executes duty control to turn on the plurality of heaters. Further, the heater controller 10 linearly corrects the total power amount of the plurality of heaters with respect to the predetermined duty according to the voltage values detected by the plurality of voltage detectors and the rated output values of the heaters. The heater controller 10 assigns the maximum turn-on duty obtained by adding the turn-on duties of the plurality of heaters to each of the plurality of heaters so that the maximum output value of each of the plurality of heaters becomes a constant value and executes duty control in descending order of turn-on priority to turn on the plurality of heaters. Further, when the turn-on priority is changed while the fixing device 125 is driven, the heater controller 10 linearly corrects the total power amount of the plurality of heaters with respect to the predetermined duty according to the voltage values detected by the plurality of voltage detectors and the rated output values of the heaters.

A part or the whole of the functional configuration of the image forming apparatus 100 described above may be implemented as either software or hardware.

In the above description, the duty represents the ratio of the time the heater is activated relative to the total that is a control period.

Figure 5:
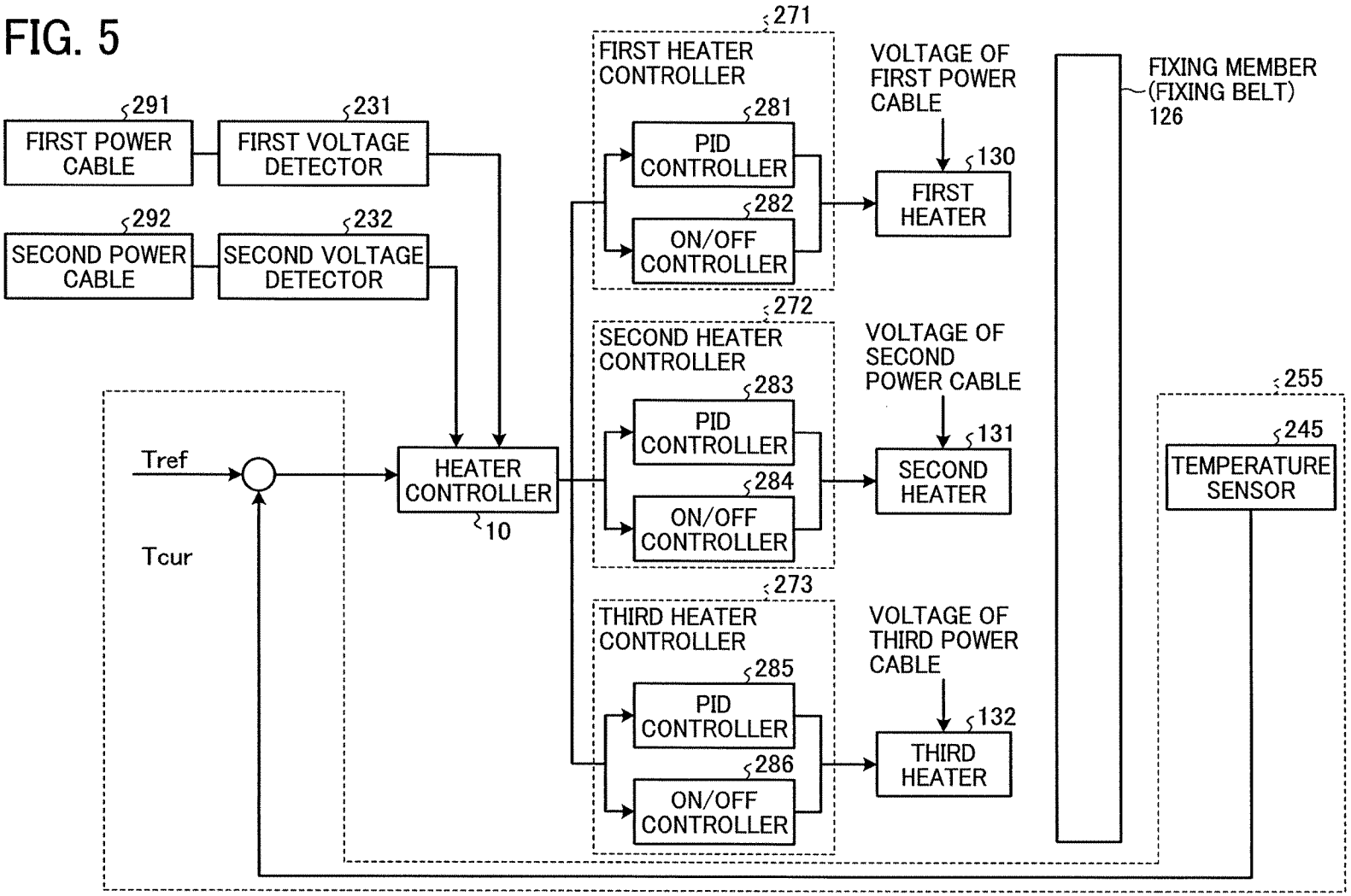
FIG. 5 is a block diagram of a fixing device controller according to the embodiment.

FIG. 5 is a block diagram of a fixing device controller 220 according to the present embodiment. As illustrated in FIG. 5, the fixing device controller 220 includes a feedback unit 255, a first heater controller 271, a second heater controller 272, and a third heater controller 273.

Based on a temperature detected by the temperature sensor 245, the feedback unit 255 calculates a difference (=Tref−Tcur) between the target value (Tref) of the fixing temperature of the fixing belt 126 and the current temperature (Tcur) of the fixing belt 126 detected by the temperature sensor 245. The feedback unit 255 sends the calculated difference value to the heater controller 10. The first heater controller 271 includes a PID controller 281 and an on/off controller 282. The second heater controller 272 includes a PID controller 283 and an on/off controller 284. The third heater controller 273 includes a PID controller 285 and an on/off controller 286. The first heater controller 271, the second heater controller 272, and the third heater controller 273 perform turn-on control of each heater described later.

PID, or Proportional Integral Differential, is a type of control involving proportional control (P), integral control (I), and differential control (D) of an input value based on the difference between a set value and a present value, so that the present value becomes the set value.

In this example, the rated current of the power supply connected to a first power cable 291 is 20 A, and the rated current of the power supply connected to a second power cable 292 is 20 A.

The first power cable 291 is connected to the first heater 130. A voltage from the first power cable is applied to the first heater 130. The second power cable 292 is connected to the second heater 131 and the third heater 132. A voltage from the second power cable 292 is applied to the second heater 131 and the third heater 132. The first voltage detector 231 detects the voltage of the first power cable 291. The second voltage detector 232 detects the voltage of the second power cable 292. The heater controller 10 receives the voltages detected by the first voltage detector 231 and the second voltage detector 232 and performs predetermined control based on the detected voltages.

Next, an example of control is described in which allocation control of the turn-on duty of each heater makes a relation between the turn-on duty of each heater and the output linear.

First, a turn-on priority, which is also referred to as a turn-on priority order, and a turn-on pattern of each heater are described. Here, a heater A, a heater B, and a heater C are used as heater names under control, and the turn-on priority order is heater A, heater B, heater C. As illustrated in the following table 1, three patterns are set to assign the actual first heater 130, second heater 131, and third heater 132 to the heaters A, B, and C.

TABLE 1

| Pattern No. | Heater A | Heater B | Heater C |
|---|---|---|---|
| 1 | First heater | Second heater | Third heater |
| 2 | Third heater | First heater | Second heater |
| 3 | Second heater | Third heater | First heater |

The turn-on duty of each heater of the first heater 130, the second heater 131, and the third heater 132 is calculated by PID calculation. Although three heaters are actually used in the present embodiment, the calculation is performed assuming that one heater is used, and 0% or more is outputted. Even if a calculation result is 100% or more, the result is used. The calculated value is tripled.

Next, allocation example of duty is described. When a voltage is applied to the halogen heater and the power is stabilized, the output power Hw of the heater is calculated by the following relational expression.

$$Hw=Htw\times(Vin/Vt)\hat{}(1.54)$$

Wherein Hw is the output power of the heater,

Htw is an output power of the heater at a rated voltage,

Vin is an applied voltage, and

Vt is a rated voltage of heater.

From the above equation, the ratio of the output voltage when different voltages are applied to the same heater is the voltage ratio to the power of 1.54.

Subsequently, calculation is performed assuming that different voltages are applied to the heater A, the heater B, and the heater C for control. In the present embodiment, since the same power cable is used for the second heater 131 and the third heater 132, the same voltage is applied to the second heater 131 and the third heater 132, but for calculation purposes, the calculation is designed to be able to calculate a case when different voltages are applied to the heaters 131 and 132. This enables to calculate the case when the power cable is increased to apply voltages to the plurality of heaters. In this example, as a name of the voltage, the voltage from the first power cable 291 is described as the main power voltage (Vmain) and the voltage from the second power cable 292 is described as the sub power voltage (Vsub). It is assumed that the reference voltage used for the calculation is the sub power voltage which is the voltage from the second power cable 292. The PID calculation gives output duties of three heaters, that is, the first heater 130, the second heater 131, the third heater 132. The reference voltage is applied to any of the three heaters.

Definitions of parameters used for control are described in Table 2. D in Table 2 is a value obtained by tripling the result of PID calculation and is referred to as calculated duty.

TABLE 2

| Heater name for control | Heater identification | Turn-on priority | Applied voltage (V) | Duty | Output coefficient with sub power voltage (Vsub) | Duty (%) |
|---|---|---|---|---|---|---|
| Heater A | Ha | 1 | Va | D | Ka = (Va/Vsub)^1.54 = f(Va/Vsub) | Da |
| Heater B | Hb | 2 | Vb | | Kb = (Vb/Vsub)^1.54 = f(Vb/Vsub) | Db |
| Heater C | Hc | 3 | Vc | | Kc = (Vc/Vsub)^1.54 = f(Vc/Vsub) | Dc |

Figure 6:
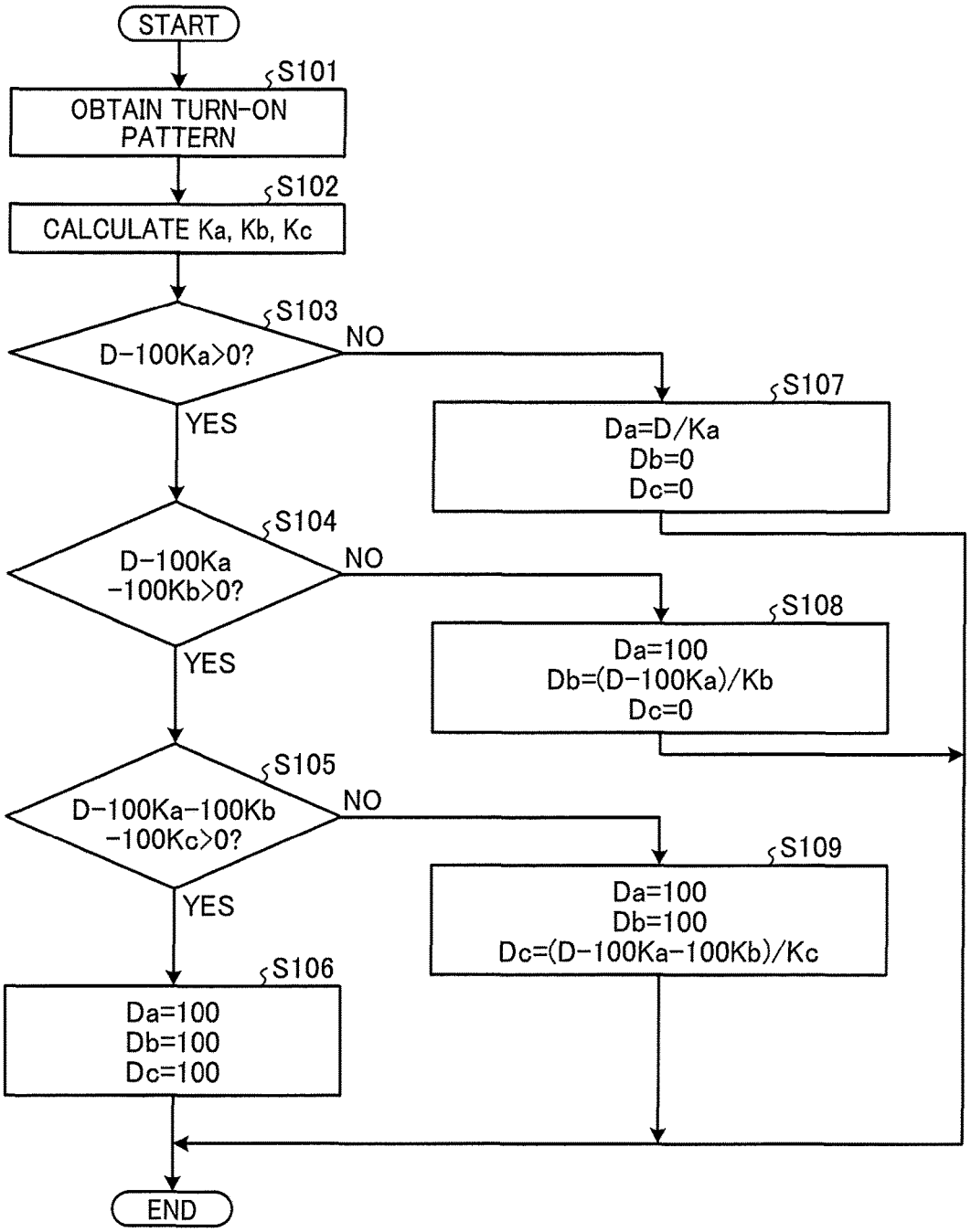
FIG. 6 is a flowchart illustrating an example of an allocation of duty according to the embodiment.

With reference to the flowchart in FIG. 6, an example of duty allocation processing is described. In FIG. 6, the duty allocation is executed in order of the heater A, the heater B, and the heater C. Coefficient calculation for the duty allocation is executed for the first heater to which the main power voltage (Vmain) is applied when the sub power voltage (Vsub) is applied to the second heater and the third heater.

Upon start of the processing, the heater controller 10 acquires the calculated duty, that is, D=63×3=189%. The heater controller 10 acquires the turn-on pattern in the table 1 (step S101). When the heater controller 10 selects the pattern 2 in table 1, the heater A, the heater B, and the heater C for control correspond to the actual heaters, that is, the first heater 130, the second heater 131, the third heater 132 and the applied voltages as follows.

The heater A=the third heater 132 to which the sub power voltage is applied.

The heater B=the first heater 130 to which the main power voltage is applied.

The heater C=the second heater 131 to which the sub power voltage is applied.

Subsequently, the heater controller 10 calculates output coefficients Ka, Kb, Kc with the sub power voltage (Vsub) (step S102). Here, it is assumed that the voltage detection result of a main power (the first power cable 291) is 236V and the voltage detection result of a sub power (the second power cable 292) is 200V.

Ka=1

Kb=(236/200)^1.54=1.29

Kc=1

Subsequently, the heater controller 10 determines whether the heater A can satisfy the duty, that is, (D−100Ka) is larger than zero (step S103). In this example, [D−100Ka>0] →189−100=89>0, which means that only the heater A cannot obtain the required output. In step S103, when the heater controller 10 determines (D−100Ka) is larger than zero, that is determination result is Yes, the process proceeds to step S104, and in the case of determination No, the process proceeds to step S107.

In step S107, the heater controller 10 calculates the duty of the heater A. On the other hand, in step S104, the heater controller 10 determines whether the heater A+the heater B can satisfy the duty, that is, (D−100Ka−100Kb) is larger than zero. In this example in step S104, (D−100Ka−100Kb) becomes larger than zero, that is, 189−100−129=−40. A voltage higher than that of the heater A is applied to the heater B, and the duty of the heater B is corrected by the coefficient Kb, that is, 1.29. This calculation result means that the heater A and the heater B can satisfy the required output. In step S104 when the heater controller 10 determines (D−100Ka−100Kb) is larger than zero, that is determination result is Yes, the process proceeds to step S105, and in the case of determination No, the process proceeds to step S108.

In step S108, the heater controller 10 calculates the duty of the heater B, that is, Da=100, Db=(D−100Ka)/Kb, and Dc=0. The calculation results become as follows.

Da=100,

Db=(189−100)/1.29=69, and

Dc=0

The heater controller 10 calculates the duty allocated to Db. Since the heater B has 1.29 times the output with the heater A with the same duty in this case, the heater controller 10 corrects the duty of the heater B using 1.29 to match the heater power of the heater A and the heater B if the heater A outputs 189%. Correction in this case is division using 1.29. This correction makes the relation between the heater duty and the output linear. Even if the turn-on pattern of the heater is changed, this calculation gives the same output for the calculated duty. On the other hand, in step S105, the heater controller 10 determines whether the heater A+the heater B+the heater C can satisfy the duty, that is, (D−100Ka−100Kb−100Kc) is larger than zero. In step S105, when the heater controller 10 determines (D−100Ka−100Kb−100Kc) is larger than zero, that is determination result is Yes, the process proceeds to step S106, and in the case of determination No, the process proceeds to step S109.

In step S109, the heater controller 10 calculates the duty of the heater C. On the other hand, in step S106, the heater controller 10 sets Da=100, Db=100, Dc=100 and ends this processing.

Next, an example is described in which the heater controller 10 limits the output of the heater. The heater controller 10 sets maximum values of duties allocated to the three heaters so that total maximum output of the heaters becomes a constant value. A value obtained by adding the three maximum values of duties is called the maximum turn-on duty.

An example of setting the maximum turn-on duty is described. When a voltage is applied to the halogen heater and the power is stabilized, the output power Hw of the heater is calculated by the following relational expression.

$$Hw=Htw\times(Vin/Vt)\hat{}(1.54)$$

Wherein Hw is the output power of the heater,

Htw is an output power of the heater at a rated voltage,

Vin is an applied voltage, and

Vt is a rated voltage of heater.

From the above equation, the ratio of the output voltage when different voltages are applied to the same heater is the voltage ratio to the power of 1.54.

Subsequently, calculation is performed assuming that different voltages are applied to the heater A, the heater B, and the heater C for control. In the present embodiment, since the same power cable is used for the second heater 131 and the third heater 132, the same voltage is applied to the second heater 131 and the third heater 132, but for calculation purposes, the calculation is designed to be able to calculate a case when different voltages are applied to the heaters 131 and 132. This enables to calculate the case when the power cable is increased to apply voltages to the plurality of heaters.

In this example, as the name of the voltage, the voltage from the first power cable 291 is described as the main power voltage (Vmain) and the voltage from the second power cable 292 is described as the sub power voltage (Vsub).

Definitions of parameters used for control are described in Table 3. The total power Wall is a limit power of the image forming apparatus 100. When the maximum powers Wma, Wmb, Wmc of the heaters are considered, it is considered that a detected voltage is lower than the true voltage by the maximum error of 2%. Therefore, it is assumed that 102% of the detected voltage is applied to the heater.

TABLE 3

| Heater name for control | Heater identification | Turn-on priority | Applied voltage (V) | Total power (W) | Maximum power per one heater | Duty of one heater (%) |
|---|---|---|---|---|---|---|
| Heater A | Ha | 1 | Va | Wall SP9-901-05 (w) or less | Wma = 1100 * (1.02 * Va/Vr)^1.54 = 1100 * f(1.02 * Va/Vr) | Dda |
| Heater B | Hb | 2 | Vb | | Wmb = 1100 * (1.02 * Vb/Vr)^1.54 = 1100 * f(1.02 * Vb/Vr) | Ddb |
| Heater C | Hc | 3 | Vc | | Wmc = 1100 * (1.02 * Vv/Vr)^1.54 = 1100 * f(1.02 * Vc/Vr) | Ddc |

Based on the above table data, $$\text{Maximum turn-on duty}=Dda+Ddb+Ddc$$

Figure 7:
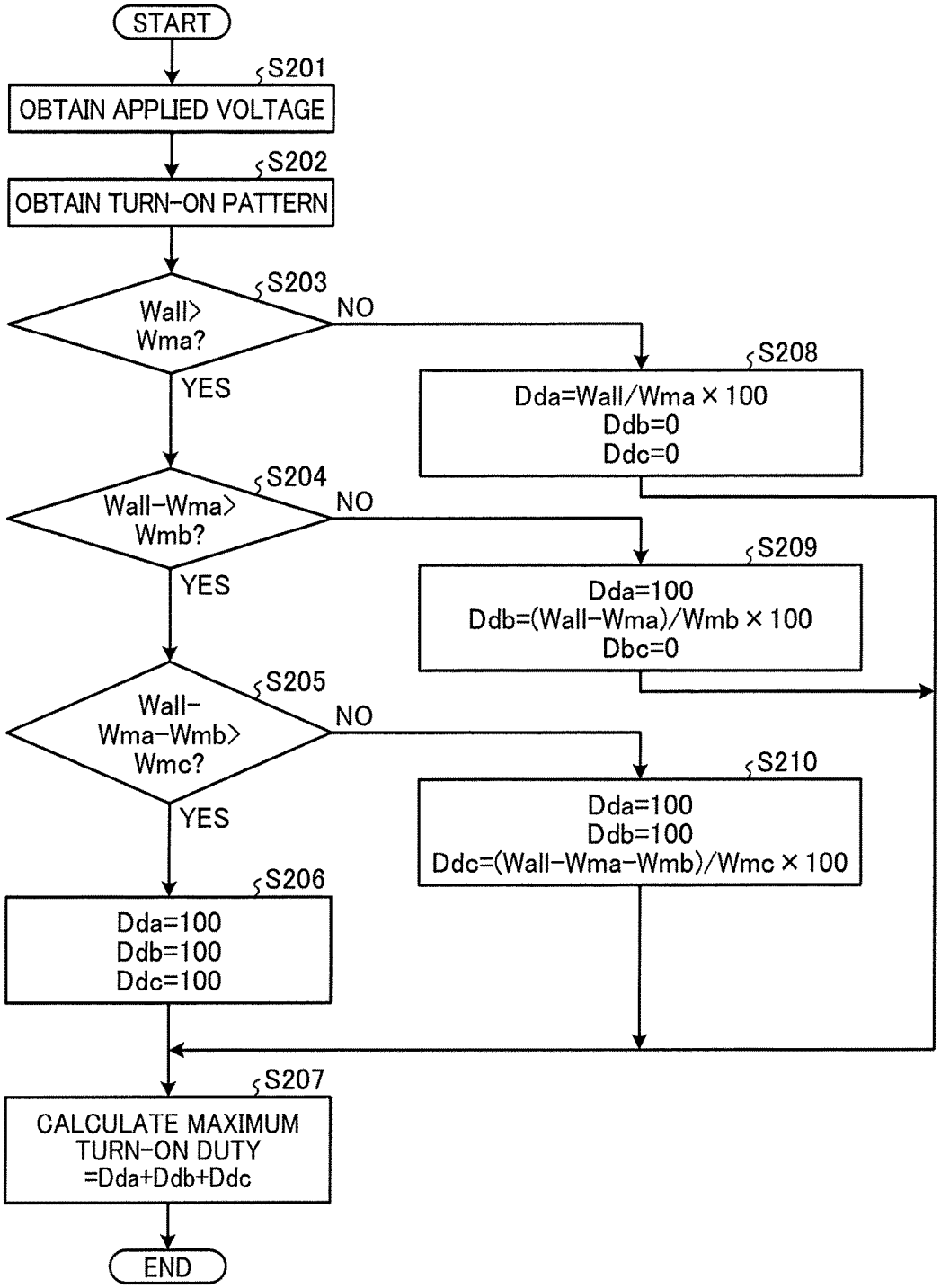
FIG. 7 is a flowchart illustrating an example of allocation calculation according to the embodiment.

With reference to the flowchart in FIG. 7, an example of a power allocation calculation is described. Here, the rated voltages of the first heater 130, the second heater 131, and the third heater 132 is assumed to be 208V. Also, in this example, it is assumed that the lowest voltage within the error range from a true value is detected, that is, the actual voltage is 102% of the detected voltage. Additionally, the heater is assumed to be the minimum tolerance product. A duty when the image forming apparatus 100 consumes the total power set for the image forming apparatus 100 under this condition is the maximum turn-on duty. Further, duty is allocated in the order of the heater A→the heater B→the heater C. The total power is assumed to be 3300 W.

In FIG. 7, firstly, the first voltage detector 231 detects the voltage applied to the first power cable 291, and the second voltage detector 232 detects the voltage applied to the second power cable 292 (step S201). It is assumed that the main power voltage detected is 200V, the sub power voltage detected is 240V, the rated voltage of the heater is 208V, the electric power of the heater is 110 W, and a tolerance range of the electric power is from −5% to 0%.

Subsequently, the heater controller 10 acquires the turn-on pattern (step S202). It is assumed that the turn-on pattern is pattern 1 in table 1 (see Table 1). At this point, the heater controller calculates the maximum power of each heater as follows.

Wma=1067 W (This voltage is applied by the main power)

Wmb=1414 W (This voltage is applied by the sub power)

Wmc=1414 W (This voltage is applied by the sub power)

Subsequently, the heater controller 10 determines whether [Wall>Wma] is satisfied (step S203). That is, the heater controller 10 confirms whether the total power Wall is larger than the maximum power of the heater A. In this example, 3300−1067>0. Therefore, the output of the heater A is smaller than the total power Wall that is the limit power of the image forming apparatus 100. In step S203, when the heater controller 10 determines [Wall>Wma], that is, determination result is Yes, the process proceeds to step S204, and in the case of determination No, the process proceeds to step S208.

In step S208, the heater controller 10 calculates the duty of the heater A, that is, Dda=Wall/Wma×100, Ddb=0, Ddc=0. On the other hand, in step S204, the heater controller 10 determines whether [Wall−Wma>Wmb] is satisfied. That is, the heater controller 10 confirms whether the total power Wall is larger than the result of adding the maximum power of the heater A and the maximum power of the heater B. In this example, 3300−1067=2233>1414. Therefore, the result of adding the maximum power of the heater A and the maximum power of the heater B is equal to or smaller than the total power Wall that is the limit power of the image forming apparatus 100. In step S204, when the heater controller 10 determines [Wall−Wma>Wmb], that is, determination result is Yes, the process proceeds to step S205, and in the case of determination No, the process proceeds to step S209.

In step S209, the heater controller 10 calculates the duties of the heater A and the heater B. That is, the heater controller 10 calculates Dda=100, Ddb=(Wall−Wma)/Wmb×100, and Ddc=0. On the other hand, in step S205, because 3300−1067−1414=819<1414, the result of adding the maximum power of the heater A, the maximum power of the heater B, and the maximum power of the heater C is equal to or larger than the total power Wall that is the limit power of the image forming apparatus 100. Therefore, it is necessary to limit the output of the heater C.

In step S205, when the heater controller 10 determines [Wall−Wma−Wmb>Wmc], that is, the determination result is Yes, the process proceeds to step S206 and in the case of determination No, the process proceeds to step S210. In step S206, the heater controller 10 sets Dda=100, Ddb=100, and Ddc=100.

When the heater controller 10 calculates [Dda=100, Ddb=100, Ddc=(Wall −Wma−Wmb)/Wmc×100] in step S210, Dda=100, Ddb=100, Ddc=(3300−1067−1414)/1414×100=57. Therefore, the limit duty of the heater C is 68%.

Subsequently, the heater controller 10 calculates [maximum turn-on duty, Max_duty=Dda+Ddb+Ddc] (step S207). As a result, in this example, Max_duty−100+100+57=257.

Next, an example is described in which the turn-on control of the heater described above is further limited. The heater controller 10 compares the maximum turn-on duty with a sum of duties of the three heaters, that is, the first heater 130, the second heater 131, and the third heater 132, each of which is allocated duty. When the sum of the turn-on duties of the three heaters exceeds the maximum turn-on duty, the heater controller 10 further executes allocation of the maximum turn-on duty to control turn-on of the heater. This limits the turn-on duty and the output of the heater.

When the heater controller 10 changes the turn-on priority order while the fixing device 125 is in operation, the heater controller 10 changes on/off pattern of the heaters (see Table 1). In the allocation control of the turn-on duty, keeping the same on/off pattern for a long time may cause temperature rise of the heater that turns on with 100% duty. Especially, a high input voltage to the heater may easily cause the temperature rise in the fixing device 125. Therefore, the heater controller 10 changes the turn-on pattern of the heater at intervals predetermined in advance. This makes it possible to avoid the temperature rise of the heater. The heater controller 10 changes on/off pattern of the heater while the sheet S is conveyed in the fixing device 125 because the temperature of the heater tends to rise during a sheet feeding, that is, while the fixing device 125 is in operation.

For example, the heater controller 10 changes the turn-on pattern of the heater (see Table 1) as follows.

[1] The heater controller 10 changes the turn-on pattern for a certain period while the fixing device 125 operates to pass the sheet S.

[2] The heater controller 10 changes the turn-on pattern when a total turn-on time that is a total time during which each of the three heaters (the first heater 130, the second heater 131, the third heater 132) turns on exceeds a certain threshold value.

[3] The heater controller changes the turn-on pattern when the number of printed sheets exceeds a preset threshold value.

[4] The heater controller 10 changes the turn-on pattern when the image forming apparatus 100 starts a new printing.

Next, comparative examples of a heater control are described. In the comparative control, the heater controller turns on three heaters by the allocation control. There are two turn-on methods of the allocation control. One is a duty control heater designation method that designates one heater that performs the duty control. For example, when there are the three heaters A, B, and C, the heater C is designated as the heater that performs duty control. Another is a priority setting method that sets a turn-on priority of a plurality of heaters. For example, the heater controller 10 sets the duty in an order of heater A→heater B→heater C. This example is illustrated in Table 4.

TABLE 4

| Requested Duty (%) | Heater | Duty control heater designation method | Priority setting method |
|---|---|---|---|
| 37 | A | 0 | 37 |
| | B | 0 | 0 |
| | C | 37 | 0 |
| 125 | A | 100 | 100 |
| | B | 0 | 25 |
| | C | 25 | 0 |
| 245 | A | 100 | 100 |
| | B | 100 | 100 |
| | C | 45 | 45 |

When the same power supply supplies power to the three heaters, even if there is a difference in the amount of heat output by the heater to the duty, the relation between the duty and the heater power that is heat quantity output by the heater is substantially linear. However, use of multiple power supply systems that output different voltages in the fixing device 125 makes the relation between the duty and the heater power nonlinear.

Figures 8A, 8B:
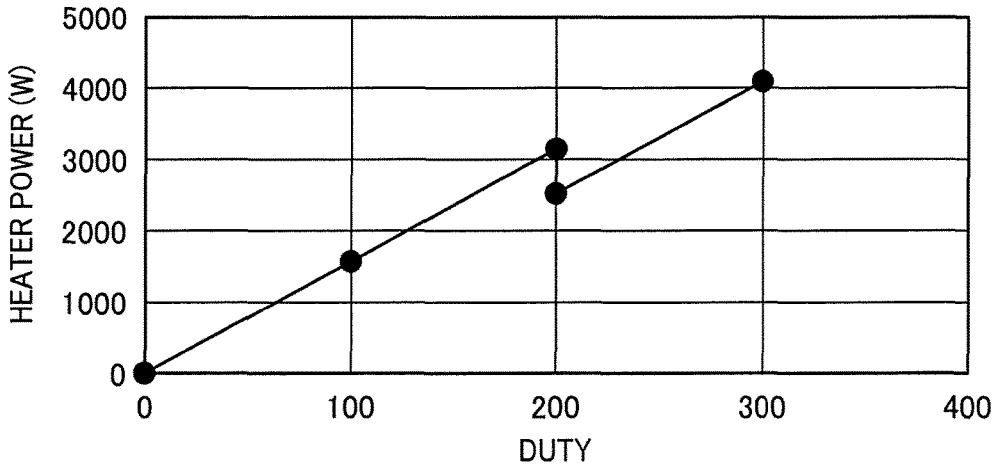
FIG. 8A is a graph illustrating relation between duty and heater power under a comparative heater control example (1)
FIG. 8B is a table illustrating a condition of the comparative heater control example (1)
Figure 9:
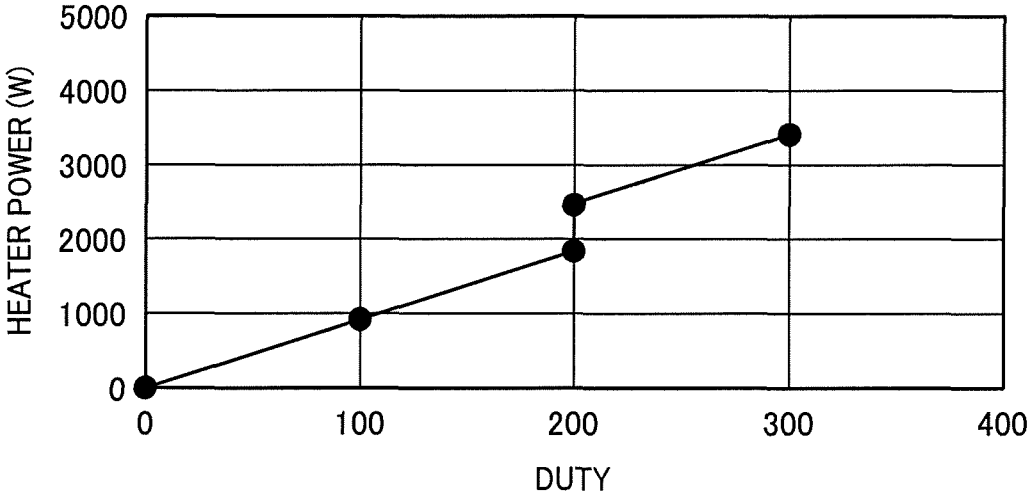
FIG. 9 is a graph illustrating relation between duty and heater power under a comparative heater control example (2)
Figures 10A, 10B:
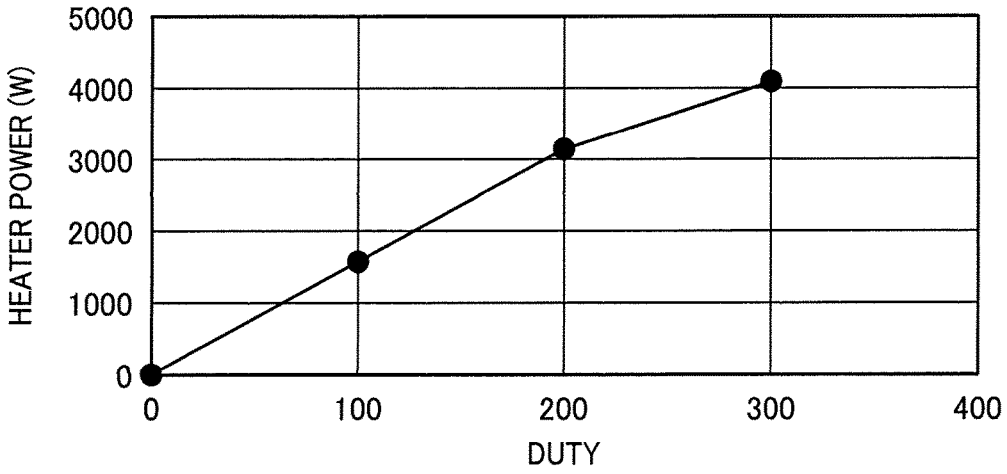
FIG. 10A is a graph illustrating relation between duty and heater power under a comparative heater control example (3)
FIG. 10B is a table illustrating a condition of the comparative heater control example (3)
Figures 11A, 11B:
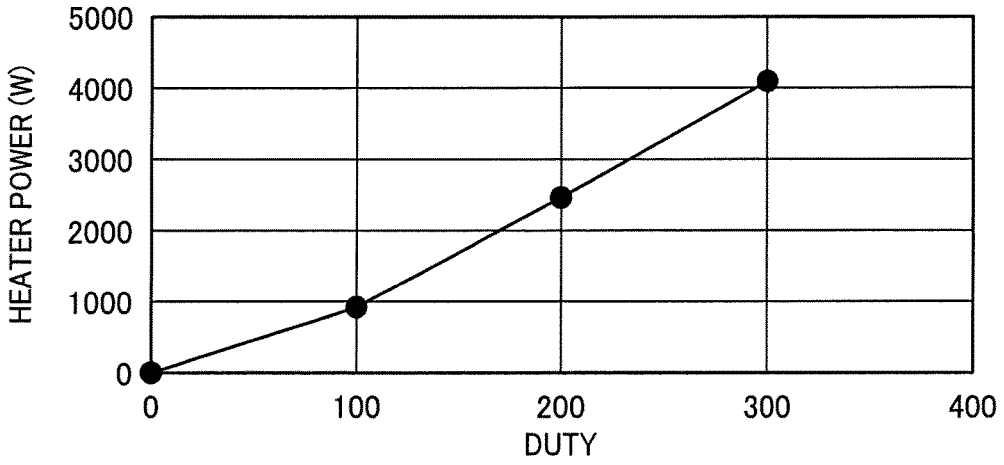
FIG. 11A is a graph illustrating relation between duty and heater power under a comparative heater control example (4)
FIG. 11B is a table illustrating a condition of the comparative heater control example (4)
Figure 12:
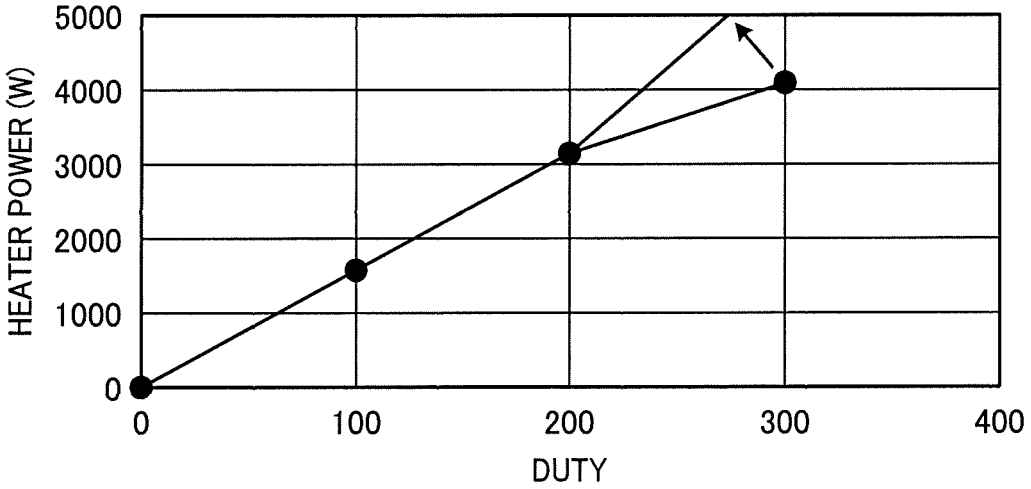
FIG. 12 is a graph illustrating relation between duty and heater power under a heater control example according to the embodiment.

As illustrated in FIGS. 8A, 8B, and 9, which illustrate examples of duty control heater designation method, the relation between the duty and the heater power includes a sudden change that may cause inversion of heater power in the worst case. As illustrated in FIGS. 10A, 10B 11A and 11B, which illustrate examples of duty control heater designation method, the relation between the duty and the heater power is not perfect linear.

On the other hand, the present disclosure solves the above-described problem about the heater control. As described above in the present embodiments, in the present disclosure, the first voltage detector 231 and the second voltage detector 232 detect the voltage applied to the heaters 130, 131, 132, and the heater controller 10 controls the heaters to correct the heater power difference from the linear relation between the duty and the heater power, that is, the heater power difference caused by the voltage difference between the plurality of power, and keep the linear relation.

As described above, the present embodiments solve a first disadvantage, a second disadvantage, and a third disadvantage as follows. The first disadvantage is nonlinearity of the relation between the duty and the heater power that is heat quantity output by the heater. The nonlinearity is caused by the power supplies that output different voltages. Such nonlinearity may cause inversion of the heater power with respect to the duty. This makes it difficult to control the temperature of the fixing belt 126 and the heating roller 129 and disadvantageously affects print quality such as uneven gloss. Therefore, in the present embodiment, a plurality of voltage detectors detect voltages applied to a plurality of power supplies, and the heater controller corrects the duty of the heaters based on each of voltages applied to the heaters to keep the linearity of the relation between the duty and the heater power and resolve the first disadvantage.

The second disadvantage is setting limit of electricity consumption. The image forming apparatus 100 needs to detect a voltage used for heater to keep the used electricity consumption within a rated value. The use of a plurality of power supplies needs setting limit of power that is determined by a plurality of detected voltages. As described above, the heater controller 10 in the present embodiment compares the maximum turn-on duty with a sum of duties of the heaters, and, when the sum of the turn-on duties of the heaters exceeds the maximum turn-on duty, the heater controller 10 executes allocation of the maximum turn-on duty again. Setting limit of the duty while the heaters turn on, as described above, enables to set the electricity consumption within the rated value.

The third disadvantage is the temperature rise of the heater. The turn-on control of the heater may cause the heater to turn on with 100% duty. Turning on with 100% duty and high input voltage may raise the temperature of the heater, possibly leading to a decrease in the life of the heater. The heater controller 10 in the present embodiment changes the turn-on priority order (See Table 1) while the heaters are turned on to avoid the temperature rise.

The heater control program executed in the image forming apparatus 100 according to the present embodiment may be provided by being installed in the ROM 222 or the like in advance. Alternatively, the above described program may be provided while being recorded on a computer-readable recording medium such as a compact disc read-only memory (CD-ROM), a flexible disk (FD), a compact disc recordable (CD-R), or a digital versatile or digital video disk (DVD), in a file in installable or executable format.

Furthermore, the program executed in the present embodiments may be configured to be provided as being stored on a computer connected to a network, such as the Internet, and then being downloaded through the network. Also, the program executed in the present embodiments may be provided or distributed through a network, such as the Internet.

The program executed in the present embodiment may have a module configuration including each of the above-described units. As an actual hardware configuration, the CPU 221 reads and executes the program from the ROM 222 and loads each component described above into the main memory to implement the component.

It is to be noted that the above embodiment is presented as examples to realize the present disclosure, and it is not intended to limit the scope of the disclosure. These novel embodiments can be implemented in various other forms, and various omissions, substitutions, and changes can be made without departing from the gist of the invention. These embodiments and variations are included in the scope and gist of the invention and are included in the invention described in the claims and the equivalent scope thereof.

The embodiment and variations described above are preferred example embodiments of the present disclosure, and various applications and variations may be made without departing from the scope of the present disclosure. For example, elements and/or features of different illustrative embodiments may be combined with each other and/or substituted for each other within the scope of the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits. A processing circuit includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A fixing device controller comprising:

a plurality of voltage detectors to detect voltages of a plurality of power sources for supplying power to a plurality of heaters to heat a fixing member of a fixing device that fixes a toner image on a recording medium; and a heater controller to execute duty control to turn on the plurality of heaters, the heater controller that corrects a duty of at least one of the plurality of heaters based on a ratio of the voltages detected by the plurality of voltage detectors and rated output values of the plurality of heaters, wherein the heater controller compares a maximum turn-on duty that is a duty when the fixing device consumes a total power set for the fixing device with a sum of turn-on duties of the plurality of heaters, and, when the sum of turn-on duties of the plurality of heaters exceeds the maximum turn-on duty, the heater controller executes allocation of turn-on duties of the plurality of heaters based on differences between the total power and maximum powers of the plurality of heaters.

2. The fixing device controller according to claim 1, wherein the heater controller corrects a duty of at least one of the plurality of heaters so that a relation between a total power of the plurality of heaters and duties used in the duty control becomes linear.

3. The fixing device controller according to claim 1, wherein the heater controller sets the duties of the plurality of heaters in a descending order of turn-on priority order of the plurality of heaters set in advance and, when the heater controller changes the turn-on priority order, corrects a duty of at least one of the plurality of heaters based on the voltages detected by the plurality of voltage detectors and the rated output values of the plurality of heaters.

4. The fixing device controller according to claim 3, wherein the turn-on priority order is changed based on an operation time of the fixing device.

5. The fixing device controller according to claim 3, wherein the turn-on priority order is changed based on a total turn-on time of the heaters.

6. The fixing device controller according to claim 3, wherein the turn-on priority order is changed based on a number of recording media on which the fixing device executes fixing.

7. The fixing device controller according to claim 3, wherein the turn-on priority order is changed in each print job in which the fixing device executes fixing.

8. The fixing device controller according to claim 1, wherein the duty control is proportional integral differential (PID) control.

9. An image forming apparatus comprising:

a fixing device to fix a toner image onto a recording medium using a fixing member; and the fixing device controller according to claim 1 to control the fixing device.

10. A fixing device control method for controlling a fixing device having a plurality of heaters to fix a toner image onto a recording medium using a fixing member in an image forming apparatus, the method comprising:

detecting voltages of a plurality of power sources for supplying power to the plurality of heaters to heat the fixing member;

when the plurality of heaters is controlled by duty control, correcting a duty of at least one of the plurality of heaters based on a ratio of the detected voltages and rated output values of the plurality of heaters;

comparing a maximum turn-on duty that is a duty when the fixing device consumes a total power set for the fixing device with a sum of turn-on duties of the plurality of heaters; and when the sum of turn-on duties of the plurality of heaters exceeds the maximum turn-on duty, the heater controller executes allocation of turn-on duties of the plurality of heaters based on differences between the total power and maximum powers of the plurality of heaters.

11. A non-transitory computer-readable recording medium that stores an executable program, wherein the program, when executed, instructs an image forming apparatus to execute a fixing device control method comprising:

detecting voltages of a plurality of power sources for supplying power to a plurality of heaters to heat a fixing member of a fixing device in the image forming apparatus;

when the plurality of heaters is controlled by duty control, correcting a duty of at least one of the plurality of heaters based on a ratio of the detected voltages and rated output values of the plurality of heaters;

comparing a maximum turn-on duty that is a duty when the fixing device consumes a total power set for the fixing device with a sum of turn-on duties of the plurality of heaters; and when the sum of turn-on duties of the plurality of heaters exceeds the maximum turn-on duty, the heater controller executes allocation of turn-on duties of the plurality of heaters based on differences between the total power and maximum powers of the plurality of heaters.

* * * * *